US006681927B2

(12) United States Patent
Focke et al.

(10) Patent No.: US 6,681,927 B2
(45) **Date of Patent: *Jan. 27, 2004**

(54) CIGARETTE PACK

(75) Inventors: Heinz Focke, Verden (DE); Dieter Neuber, Upper Saddle River, NJ (US)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/158,458

(22) Filed: May 31, 2002

(65) Prior Publication Data

US 2003/0010656 A1 Jan. 16, 2003

Related U.S. Application Data

(63) Continuation of application No. 09/622,720, filed as application No. PCT/EP99/01106 on Feb. 20, 1999, now Pat. No. 6,401,918.

(30) Foreign Application Priority Data

Feb. 23, 1998 (DE) ..... 198 07 438

(51) Int. Cl.[7] ..... B65D 85/18

(52) U.S. Cl. ..... 206/268; 206/265; 206/831; 206/254; 229/160.1

(58) Field of Search ..... 206/268, 265, 206/831, 264, 271, 273, 275, 254, 459.1, 497; 229/160.1, 245, 100

(56) References Cited

U.S. PATENT DOCUMENTS

| | | | | |
|---|---|---|---|---|
| 2,011,399 A | | 8/1935 | Driscoll | |
| 2,109,100 A | | 2/1938 | Brophy | |
| 3,695,422 A | | 10/1972 | Tripodi | |
| 3,809,227 A | | 5/1974 | Begemann | |
| 4,779,733 A | | 10/1988 | Kilian | |
| 5,035,935 A | | 7/1991 | Thomas et al. | |
| 5,121,879 A | | 6/1992 | Focke et al. | |
| 5,375,704 A | | 12/1994 | Focke et al. | |
| 5,427,235 A | | 6/1995 | Powell et al. | |
| 6,401,918 B1 | * | 6/2002 | Focke et al. | 206/268 |

FOREIGN PATENT DOCUMENTS

| | | |
|---|---|---|
| DE | 89 07 894.2 | 10/1989 |
| DE | 4 237 523 | 5/1994 |
| DE | 195 01 820 | 8/1995 |
| DE | 4 437 782 | 5/1996 |
| DE | 296 06 753 | 8/1996 |
| DE | 196 16 871 | 10/1997 |
| FR | 756 121 | 12/1933 |
| FR | 1 463 879 | 12/1996 |
| GB | 2 304 671 | 3/1977 |
| GB | 2 266 695 | 11/1993 |
| WO | WO 97 09241 | 3/1997 |
| WO | WO 97 19860 | 6/1997 |

OTHER PUBLICATIONS

Die Verwirklichung enines neuen Verpakungskonzeptes, Nov. 1991.

* cited by examiner

*Primary Examiner*—Jila M. Mohandesi
(74) *Attorney, Agent, or Firm*—Sughrue Mion, PLLC

(57) ABSTRACT

A (cigarette) pack, in particular a hinge-lid box (10), with an outer wrapper (24) made of thin, transparent film includes a printing carrier (30) which is arranged, between the hinge-lid box (10) and outer wrapper (24), with (zigzag) folding. The printing carrier (30) is positioned in the region of an end wall (22) such that automatic unfolding takes place when the outer wrapper (24) is opened.

2 Claims, 3 Drawing Sheets

CIGARETTE PACK

This is a continuation of application Ser. No. 09/622,720 filed Nov. 11, 2000; now U.S. Pat. No. 6,401,918 dated Jun. 11, 2002, which is a 371 of PCT/EP99/01106 filed Feb. 20, 1999 the disclosure of which is incorporated herein by reference.

BACKGROUND OF THE INVENTION

The invention relates to a cigarette pack having an outer wrapper made of transparent film, a printing carrier or coupon comprising a separate blank being arranged between the pack and the outer wrapper.

In particular in the case of cigarette packs, there is an increasing need for the packs to be assigned printing carriers which contain information, serve for advertising purposes or else provide eligibility for participating in prize draws etc. In the case of cigarette packs, which are usually provided with an outer wrapper made of transparent film, it is advantageous for the printing carrier (coupon) to be positioned between the pack and the outer wrapper. This means that the printing carrier can be seen from the outside when the pack unit is intact.

Packs made of cellophane or plastic, for example for accommodating tablets, which are provided with a film wrapper or encircling film strip, are known. Leaflets or product information are/is placed, as the folded printing carrier, in an outer recess of the pack and preferably adhesively bonded to said pack, it being possible for the printing carrier to be unfolded manually, following removal of the outer wrapper, without the pack being opened (GB 2 304 671).

SUMMARY OF THE INVENTION

The object of the invention, in the case of a pack or pack unit mentioned in the introduction, is to design and arrange the printing carrier such that more information can be given by way of the printing carrier and there is an improvement in presentation when the pack is opened for the first time. In particular, the intention is for the printing carrier to unfold when the outer wrapper is removed.

In order to achieve this object, the pack according to the invention is characterized in that the printing carrier is connected to the pack, on the one hand, and to the outer wrapper, on the other hand, a part of the printing carrier which is directed towards the pack, namely a folding section, being connected to the pack and a folding section which is directed towards the outer wrapper being connected to the outer wrapper, preferably by spots of glue.

By virtue of the folded arrangement of the printing carrier, the latter may be designed as a comparatively long, strip-like blank which may hold a considerable amount of different information, if appropriate corresponding to a subdivision into sections. The zigzag folding facilitates the unfolding of the blank or printing carrier. In the folded state, the printing carrier forms a structure which has a small surface area and, overall, takes up only a small amount of space.

A special feature is that the configuration of the (folded) printing carrier is coordinated with the design of the pack such that, when the pack is opened or used for the first time, the printing carrier is unfolded automatically. For this purpose, the printing carrier is connected in an easily releasable manner to the pack, on the one hand, and to the wrapper, on the other hand. When part of the wrapper is removed, the printing carrier is unfolded, in particular by virtue of a (top) cap of the outer wrapper being removed.

An exemplary embodiment of the printing carrier and of a pack provided with said printing carrier is explained in more detail hereinbelow with reference to the drawings, in which:

DETAILED DESCRIPTION OF THE INVENTION

Figure 2:
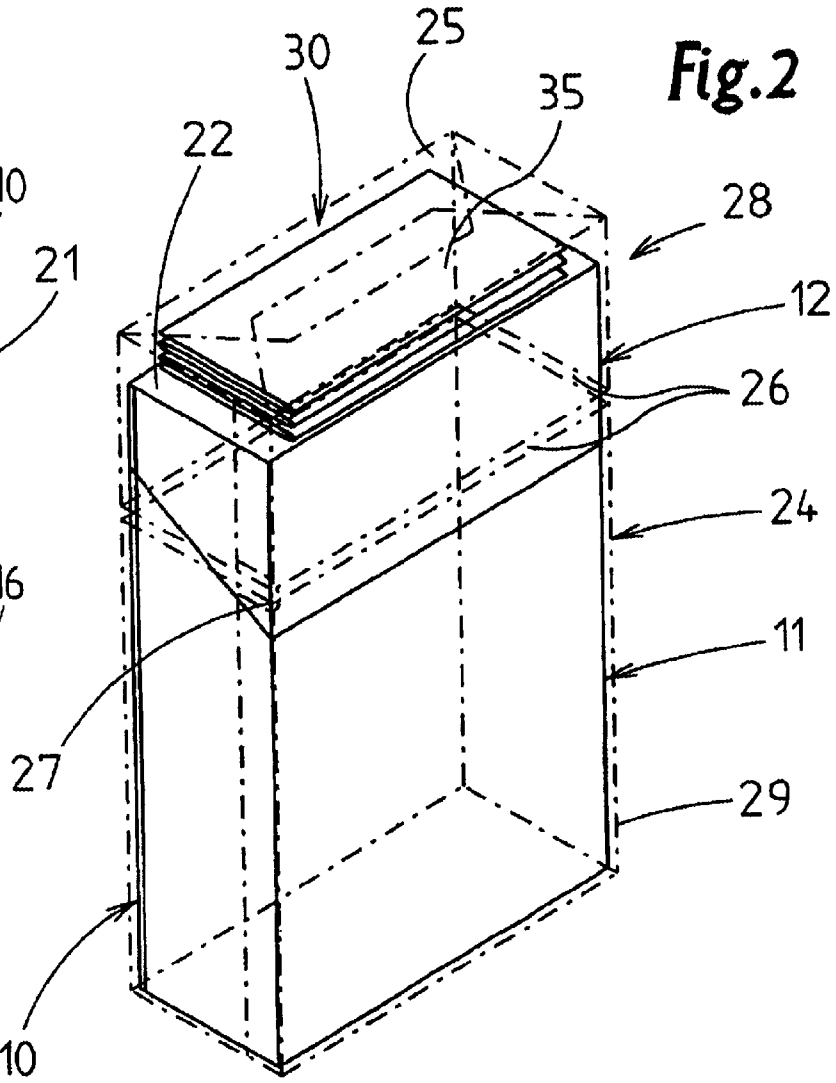
FIG. 2 shows the pack according to FIG. 1 with an outer wrapper.
Figure 1:
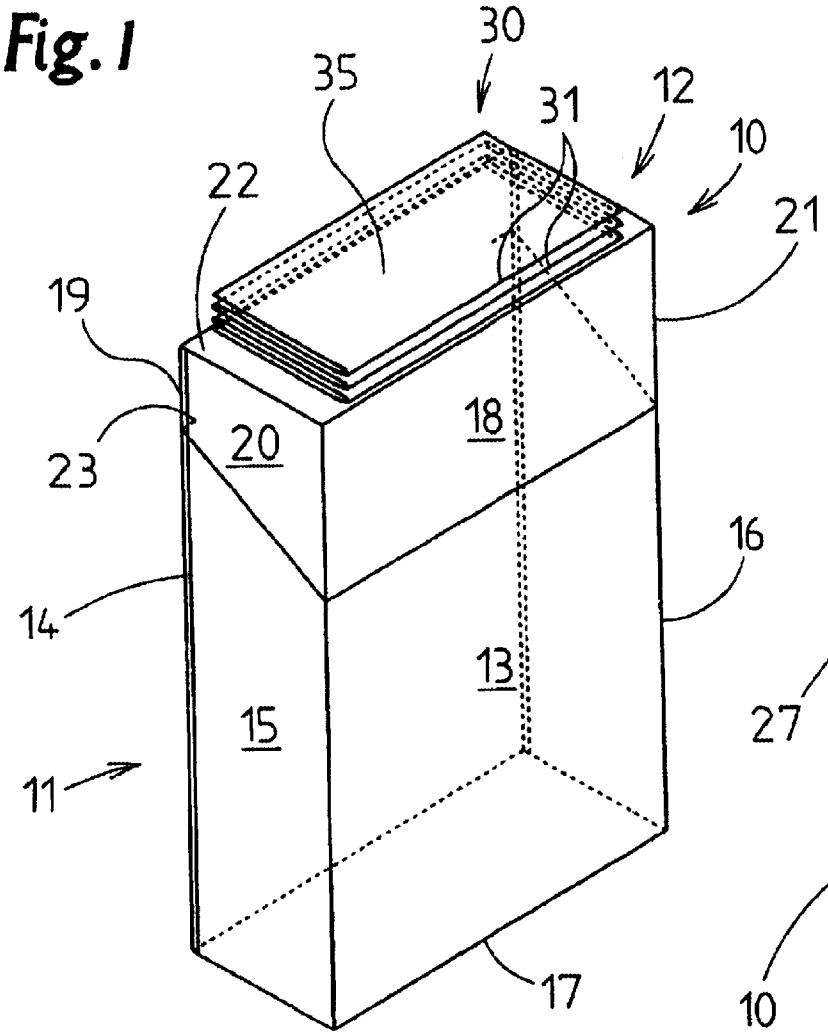
FIG. 1 shows a perspective illustration of a (cigarette) pack with a folded printing carrier.

The details illustrated in the drawings relate to cigarette packs of the hinge-lid box type 10. Such a pack consists of (thin) cardboard. The cuboidal hinge-lid box 10 comprises a (bottom) box part 11 and a (top) lid 12. The box part 11 is bounded by a front wall 13, an opposite, rear wall 14, by narrow, upright side walls 15, 16 and by a base wall 17. Correspondingly, the lid 12 comprises a lid front wall 18, a lid rear wall 19, narrow lid side walls 20, 21, which adjoin the side walls 15, 16, and a top end wall 22 opposite the base wall 17. The box part 11 and lid 12 are connected to one another with swing action by an articulation line 23 in the region of the rear wall 14 and the lid rear wall 19.

Before it is used for the first time, the pack or hinge-lid box 10 formed in this way is enclosed by an outer wrapper 24. The latter consists of thin, transparent film. The outer wrapper 24 encloses the entire hinge-lid box 10, but it should fit on all sides, the top outer end wall 25 being formed in the process.

For the purpose of opening the pack unit, comprising hinge-lid box 10 and outer wrapper 24, for the first time, part of the outer wrapper 24 is removed. For this purpose, the outer wrapper 24 is provided, in a top region, with an encircling tear-open strip 26. The latter is connected to the blank of the outer wrapper 24 in a known matter by adhesive bonding or sealing. In the region of one side wall, a free end of the tear-open strip 26 is provided with a grip tab 27 which can be gripped by hand. Said grip tab is gripped for the purpose of opening the outer wrapper 24 with the aid of the tear-open strip 26.

Figure 5:
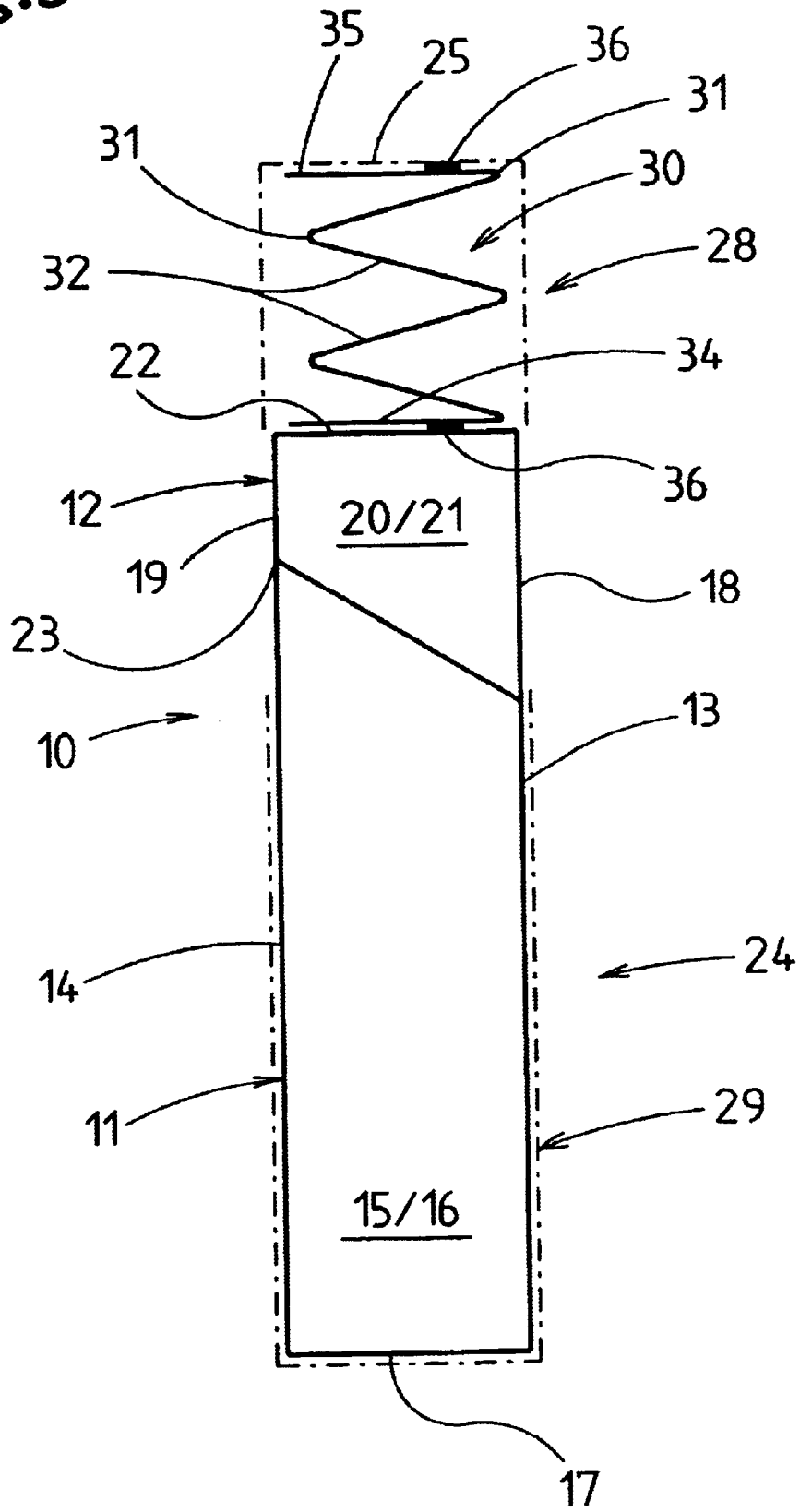
FIG. 5 shows a side view of a (cigarette) pack as the latter is opened.

The tear-open strip 26 is arranged such that a top sub-region of the outer wrapper 24, namely a cap 28, is severed from the bottom part of the same. Following the severing operation, said cap can be lifted off upwards from the pack or hinge-lid box 10 (FIG. 5). This means that at least the lid 12 is completely exposed, with result that access to the pack contents is possible by virtue of the lid 12 being opened. A cup-like bottom film part 29 may remain on the hinge-lid box 10 or on the box part 11.

The pack unit, which comprises the pack or hinge-lid box 10 and the outer wrapper 24, is assigned a printing carrier 30. The latter comprises a thin blank (FIG. 3), in particular made of paper. The printing carrier 30 is provided on one side or both sides with printing which contains information, advertising, etc. However, it is also possible for the printing carrier 30 to serve wholly or in part as a coupon for participation in prize draws or the like.

Figure 4:
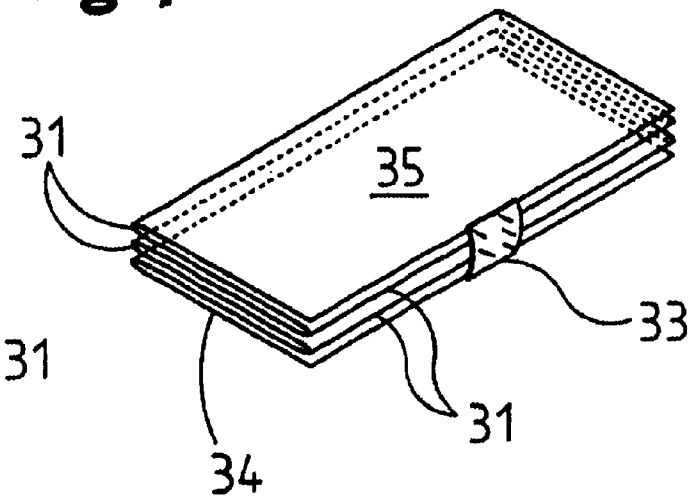
FIG. 4 shows a perspective illustration of a printing carrier folded in zigzag form.
Figure 3:
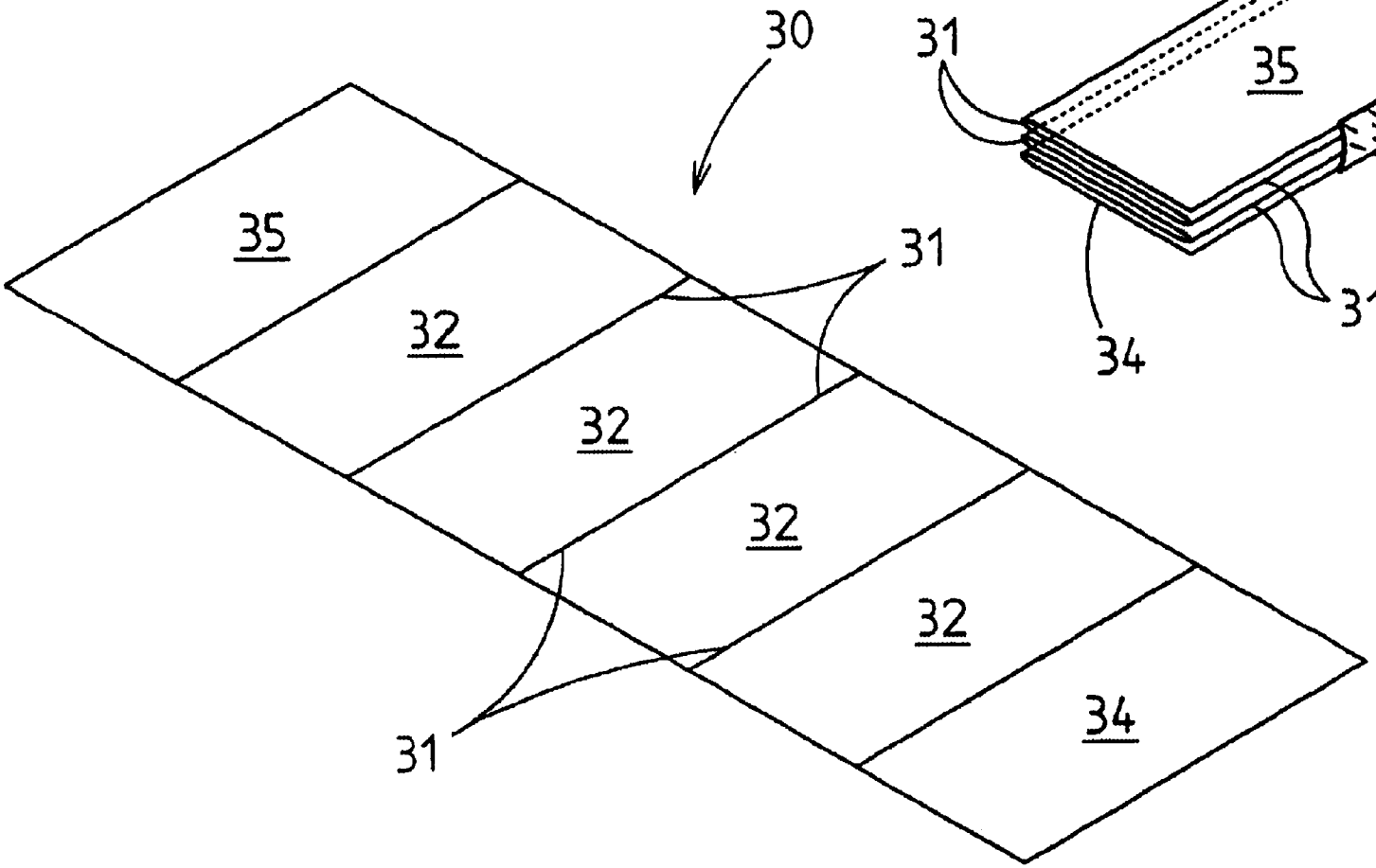
FIG. 3 shows a blank for a printing carrier in the spread-out state.

The blank of the printing carrier 30 is an elongate, strip-like arrangement (FIG. 3). By way of transversely directed folding lines 31, the printing carrier 30 can be folded together to form a comparatively small, compact assembly (FIG. 4). Folding is carried out such that sections 32 of the printing carrier 30, said sections being bounded by folding lines 31, are folded in zigzag form or in the manner of an accordion.

The printing carrier 30 is expediently prefabricated in the factory, that is to say folded and delivered in the ready-for-packaging state. In order to ensure the folded position, there is provided, according to FIG. 4, a small, unobtrusive connecting means, namely, for example, a strip of glue 33, a small tape or the like. Said strip of glue 33 serves merely for holding the folded printing carrier 30 together during transportation, storage and packaging.

The folded printing carrier 30 is positioned between the pack or hinge-lid box 10 and the outer wrapper 24. The printing carrier 30 is advantageously arranged in the region of the end wall 22 of the lid, namely between said end wall 22, on the one hand, and the outer end wall 25 of the outer wrapper. The printing carrier 30 is dimensioned such that, following folding, that is to say in the position according to FIG. 4, the surface area of the end wall 22 is not exceeded. In the present exemplary embodiment, the printing carrier 30 is of approximately the same width as the end wall 22 and is slightly shorter than the same.

The printing carrier 30 is fitted, namely fixed, in a specific manner such that the printing carrier 30 is unfolded automatically when the pack unit is opened. For this purpose, a leg 34, which is directed towards the end wall 22—a border zone of the blank according to FIG. 3—is connected to the end wall 22 in an easily releasable manner. An opposite, border-side leg 35 is connected correspondingly to the inner side of outer end wall 25. The connection can take place by spots of glue 36. The spots of glue 36 are dimensioned and formed such that the printing carrier 30 can easily be released from the outer wrapper 24 and the hinge-lid box 10 once the outer wrapper 24 has been opened. In particular, said glue may be one with peeling properties.

The positioning of the printing carrier 30 and the folding of the same ensure automatic unfolding when the outer wrapper 24 is opened by virtue of the cap 28 being drawn off. The printing carrier 30 is fixed in said cap 28, with result that, when the cap is lifted off from the pack or hinge-lid box 10 (FIG. 5), the printing carrier 30 is unfolded as result of being connected to the end wall 22.

Following removal of the printing carrier 30, the hinge-lid box 10 is utilized in the conventional manner.

List of Designations

| | |
|---|---|
| 10 | Hinge-lid box |
| 11 | Box part |
| 12 | Lid |
| 13 | Front wall |
| 14 | Rear wall |
| 15 | Side wall |
| 16 | Side wall |
| 17 | Base wall |
| 18 | Lid front wall |
| 19 | Lid rear wall |
| 20 | Lid side wall |
| 21 | Lid side wall |
| 22 | End wall |
| 23 | Articulation line |
| 24 | Outer wrapper |
| 25 | Outer end wall |
| 26 | Tear-open strip |
| 27 | Grip tab |
| 28 | Cap |
| 29 | Bottom film part |
| 30 | Printing carrier |
| 31 | Folding line |
| 32 | Section |
| 33 | Strip of glue |
| 34 | Leg |
| 35 | Leg |
| 36 | Spot of glue |

What is claimed is:

1. A cigarette pack (10) with an outer wrapper (24) made of transparent film and with a tear-open strip (26) running around the pack (10) on the outer wrapper (24) for the purpose of severing an upper cap (28) of the outer wrapper (24), a printing carrier (30) or coupon being disposed between the pack (10) and the outer wrapper, wherein:

a) the printing carrier (30) is folded to form at least two folded sections or legs (34, 35), one of which faces toward the pack, and the other of which faces toward the outer wrapper;

b) the printing carrier (30) is removably connected to the pack (10) in a region of the one folded section or leg (34) facing toward the pack;

c) the printing carrier (30) is also connected to the outer wrapper (24) in a region of the other folded section or leg (35) facing toward the outer wrapper (24); and d) the printing carrier (30) or one of its legs (35) is connected to the outer wrapper (24) in a region of the upper cap (28) which is to be severed by the tear-open strip (26).

2. The cigarette pack according to claim 1, wherein the printing carrier is removably connected to the pack (10) by small or easily dissolvable glue beads (36).

* * * * *